US008419012B2

(12) United States Patent
Otsuki

(10) Patent No.: US 8,419,012 B2
(45) Date of Patent: Apr. 16, 2013

(54) RECORDING-SHEET RETAINING DEVICE

(75) Inventor: Yasuyuki Otsuki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/361,119

(22) Filed: Jan. 30, 2012

(65) Prior Publication Data

US 2012/0228820 A1 Sep. 13, 2012

(30) Foreign Application Priority Data

Mar. 11, 2011 (JP) ..... 2011-053974

(51) Int. Cl.
*B65H 1/00* (2006.01)

(52) U.S. Cl.
USPC ..... 271/145; 271/157; 271/171

(58) Field of Classification Search ..... 271/145, 271/157, 171; 221/227, 242, 279
See application file for complete search history.

(56) References Cited

U.S. PATENT DOCUMENTS

| | | | | |
|---|---|---|---|---|
| 5,419,544 | A * | 5/1995 | Ono et al. | 271/164 |
| 2011/0221121 | A1* | 9/2011 | Hamasaki et al. | 271/145 |
| 2011/0272879 | A1* | 11/2011 | Ushiyama et al. | 271/227 |

FOREIGN PATENT DOCUMENTS

| | | |
|---|---|---|
| JP | 02-108883 | 8/1990 |
| JP | 06-255804 | 9/1994 |
| JP | 08-244988 | 9/1996 |
| JP | 11-091954 | 4/1999 |
| JP | 2003-212360 | 7/2003 |

* cited by examiner

*Primary Examiner* — David H Bollinger
(74) *Attorney, Agent, or Firm* — Banner & Witcoff, Ltd.

(57) ABSTRACT

A placement plate for placing a recording sheet is provided in a case to be movable upward and downward. A regulating member is supported by the case to be slidable in the width direction of the recording sheet. A locking section is provided on at least one of the placement plate and the regulating member so as to lock the placement plate with respect to the regulating member when the regulating member is located in an area different from an area between the maximum size and the minimum size at the edge of the recording sheet in the width direction.

11 Claims, 9 Drawing Sheets

RECORDING-SHEET RETAINING DEVICE

CROSS-REFERENCE TO RELATED APPLICATIONS

This non-provisional application claims priority under 35 U.S.C. §119(a) on Patent Application No. 2011-053974 filed in Japan on Mar. 11, 2011, the entire contents of which are hereby incorporated by reference.

TECHNICAL FIELD

The present invention relates to a recording-sheet retaining device for retaining recording sheets in piles.

BACKGROUND

As a device of this type, a configuration (so-called a paper feed cassette) is known which can be freely attached to and removed from a main body of an image forming apparatus and which retains recording sheets (papers) in piles inside the main body before being conveyed. Such a paper feed cassette is provided with a placement plate (also referred to as a bottom plate, middle plate or pressure plate) for supporting the piled body of the recording sheets from underneath such that the top recording sheet is in a position at which it can be conveyed (or can be retrieved).

In such a paper feed cassette, various configurations have conventionally been proposed for preventing deformation or the like of a component by fixing the placement plate so as not to move when impact is applied at the time of transportation (see Japanese Utility Model Application Laid-Open No. 2-108883 (1990), Japanese Patent Application Laid-Open No. 6-255804 (1994), Japanese Patent Application Laid-Open No. 8-244988 (1996), Japanese Patent Application Laid-Open No. 11-91954 (1999), for example).

SUMMARY

Conventional propositions of this type, however, had various problems. For example, the configuration disclosed in Japanese Utility Model Application Laid-Open No. 2-108883, Japanese Patent Application Laid-Open No. 6-255804 or Japanese Patent Application Laid-Open No. 11-91954 uses a member dedicated for fixing the placement plate at the time of transportation, which may cause a problem of incurring unnecessary cost, generating excessive waste or losing a component while a device is being transported again after it is used and thus not being reusable.

Japanese Patent Application Laid-Open No. 8-244988 discloses a configuration in which a sheet-material regulating member (rear guide or side guide) used at the time of image forming operation is removably provided with respect to a cassette, and is configured such that a middle plate is fixed by once removing the sheet-material regulating member from the cassette at the time of transportation and attaching it to an attachment section for pressing the middle plate. In such a configuration, however, a problem may be caused in the image forming operation after transportation or the like, since the sheet-material regulating member may be lost.

The present invention has been made to address the problems described above. An object of the present invention is to provide a configuration capable of fixing a placement plate at the time of transportation or the like in a favorable and reusable manner without increasing cost or generating excessive waste.

A recording-sheet retaining device according to the present invention comprises a case for retaining recording sheets in piles. A placement plate and a regulating member are provided in and supported by the case.

The placement plate is a component for placing a recording sheet and is arranged in the case to be movable upward and downward. The regulating member is supported by the case to be slidable in a width direction of the recording sheet. The regulating member is provided in contact with an edge of the recording sheet in the width direction so as to regulate a position of the edge.

The present invention is characterized in that, when the regulating member is located on at least one of the placement plate and regulating member in an area different from an area between the maximum size and the minimum size at the edge of the recording sheet in the width direction, a locking section is provided to lock the placement plate with respect to the regulating member.

In the recording-sheet retaining device of the present invention with such a configuration, the regulating member slides to the position at which the locking section locks the placement plate at the time of transportation or the like. This allows the placement plate to be favorably fixed. At this time, the position of the regulating member is within the area different from the area between the maximum size and the minimum size at the edge of the recording sheet in the width direction. Thus, the locking section will not cause a problem when the recording sheet is conveyed to the main body of the image forming apparatus.

Moreover, the locking section is provided on the regulating member or the placement plate, which are supported by the case. Thus, a particular component, which may be an excessive waste or may be lost, is not used to fix the placement plate. According to the present invention, therefore, the placement plate can be fixed at the time of transportation or the like in a favorable and reusable manner, without increasing cost or generating excessive waste.

The above and further objects and features will more fully be apparent from the following detailed description with accompanying drawings.

BRIEF DESCRIPTION OF SEVERAL VIEWS OF DRAWINGS

DETAILED DESCRIPTION

<Schematic Configuration of Laser Printer>

Figure 1:
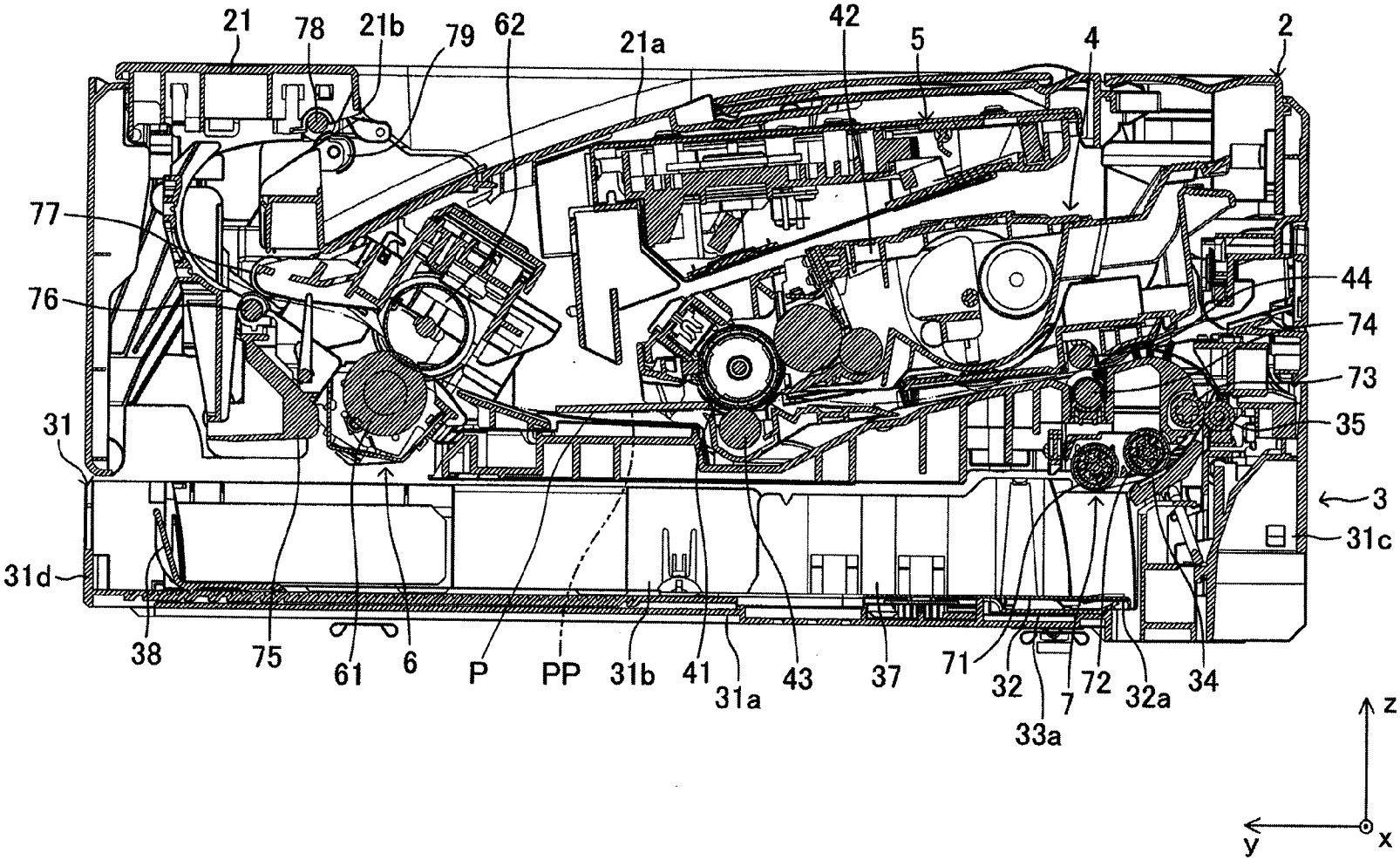
FIG. 1 is a side section view of a schematic configuration of a laser printer as an image forming apparatus to which an embodiment of the present invention is applied.

FIG. 1 is a side section view of a schematic configuration of a laser printer 1 as an image forming apparatus to which an embodiment of the present invention is applied. In the description below, the right side (the negative side of the y axis in the drawings) in FIG. 1 will be referred to as a "front surface" side of the laser printer 1, whereas the left side (the positive side of the y axis in the drawings) in FIG. 1 will be referred to as a "back surface" side of the laser printer 1. In addition, the vertical direction (the direction of z axis in the drawings) in FIG. 1 will be referred to as "height direction" or "vertical direction" of the laser printer 1, while the horizontal direction (the direction of y axis in the drawings) in FIG. 1 will be referred to as "front-back" direction of the laser printer 1. Moreover, the direction perpendicular to the sheet of FIG. 1 (the direction of x axis in the drawings) will be referred to as "width direction" or "paper-width direction" of the laser printer 1.

The laser printer 1 is configured to convey, at the inside thereof, a paper P which is a recording sheet along a paper path PP, to form an image on the paper P using developer (toner) (the image will hereinafter be referred to as "toner image"). More specifically, the laser printer 1 comprises a main body 2 and a sheet cassette 3. The main body 2 is provided with a process cartridge 4, a scanner unit 5, a fuser unit 6 and a paper conveying section 7.

A body casing 21 configuring an outer cover of the main body 2 is a box-like member, which is formed with synthetic resin. A paper receiving tray 21*a* and a paper discharge outlet 21*b* are formed at the upper part of the body casing 21. The paper receiving tray 21*a* is configured as an inclined plane inclined downward from the front surface side to the back surface side of the body casing 21. The paper discharge outlet 21*b* configured as an opening is formed on a wall of the body casing 21, the wall extending upward from the lower end of the paper receiving tray 21*a*. Thus, the paper receiving tray 21*a* is configured to be able to receive a paper P discharged from the paper discharge outlet 21*b*.

Figure 2:
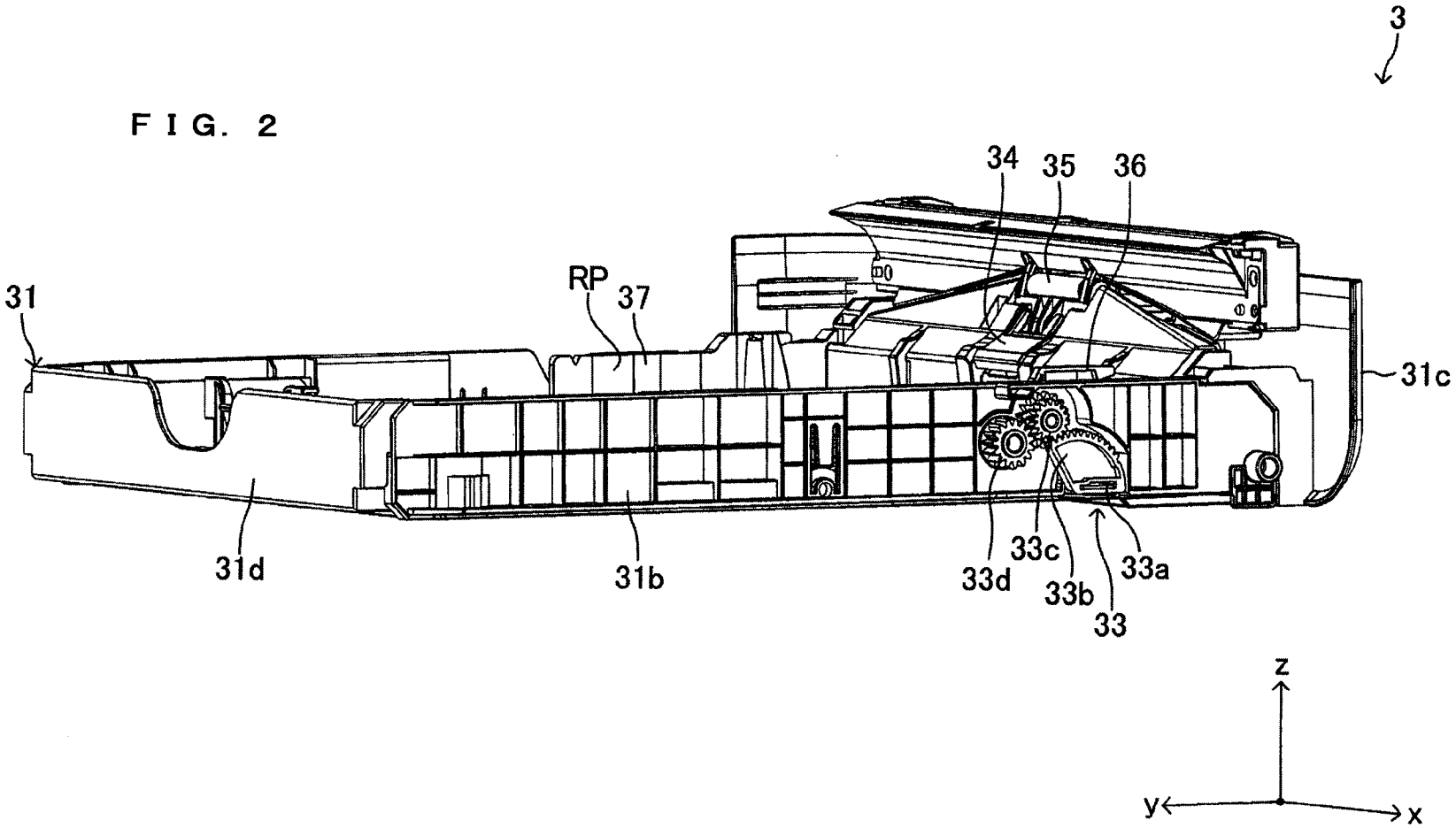
FIG. 2 is a perspective view of the entire configuration of a sheet cassette illustrated in FIG. 1 when viewed from the diagonal side.
Figure 3:
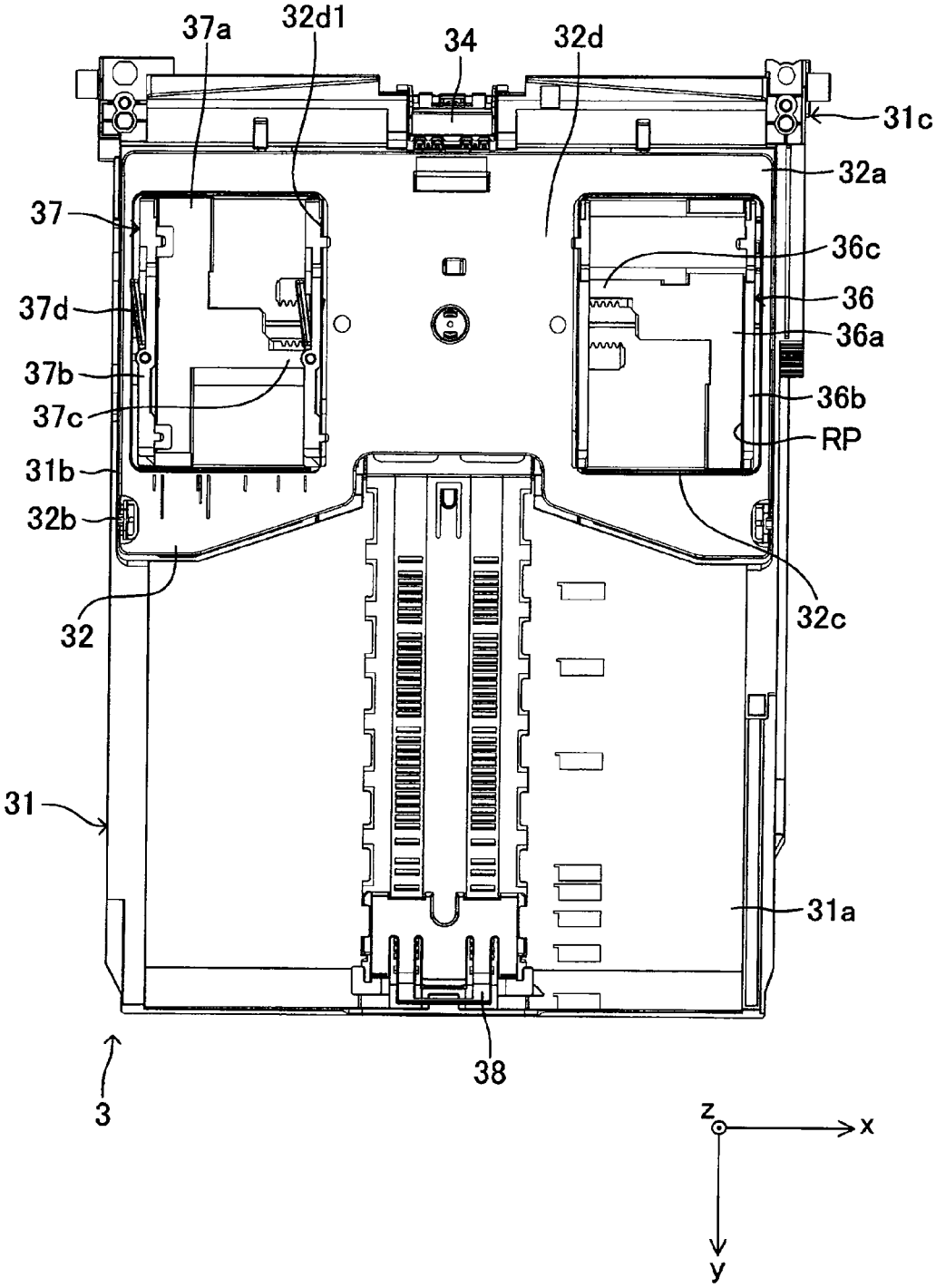
FIG. 3 is a plan view of the schematic configuration of the sheet cassette illustrated in FIG. 2.
Figure 4:
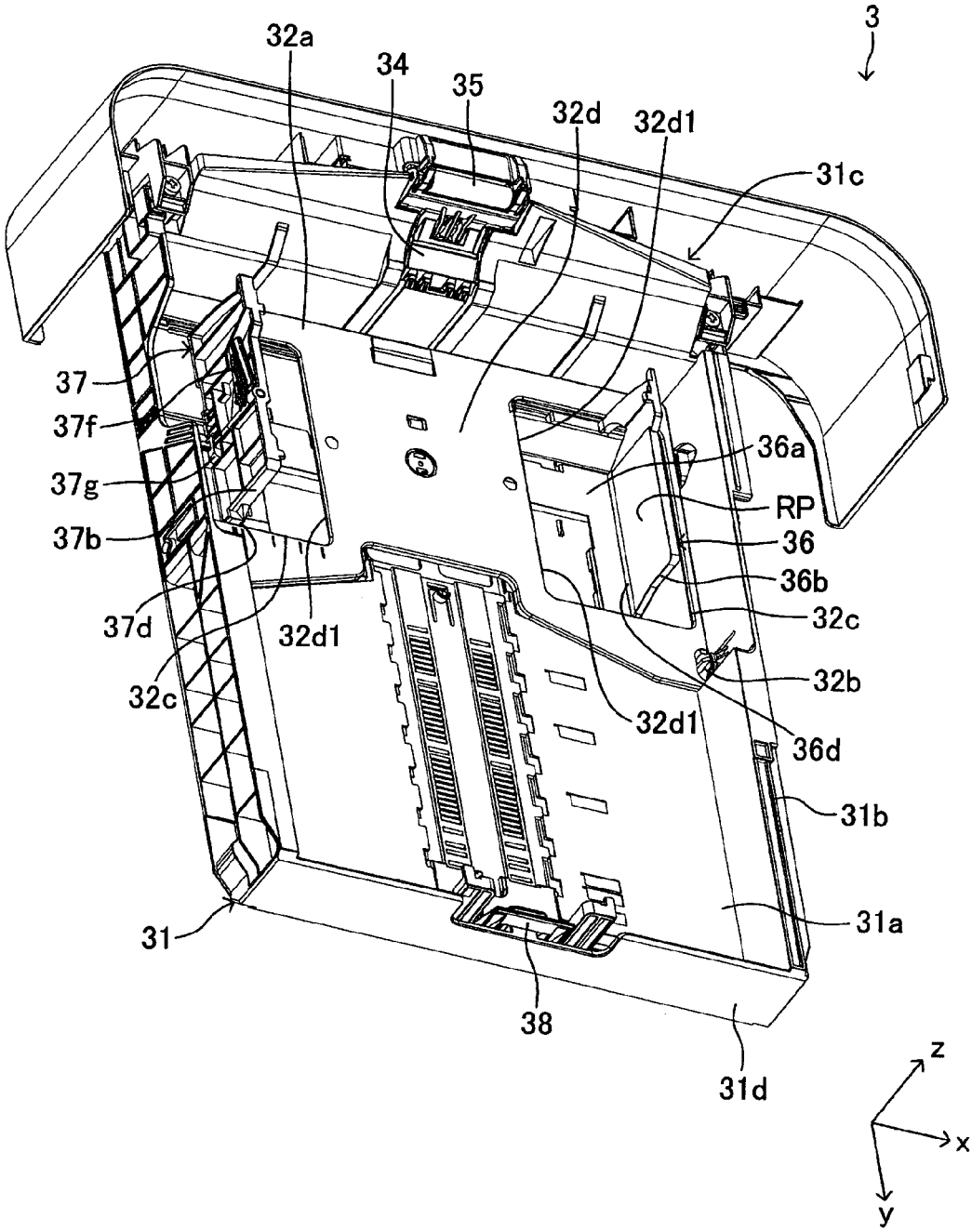
FIG. 4 is a perspective view of the sheet cassette illustrated in FIG. 2 when viewed from the upper diagonal side.

The sheet cassette 3 is housed below the main body 2. The sheet cassette 3 is configured to be removable by sliding it with respect to the lower part of the main body 2 in the front-back direction. FIG. 2 is a perspective view showing the entire configuration of sheet cassette 3 illustrated in FIG. 1 when viewed from the diagonal side. FIG. 3 is a plan view of the schematic configuration of the sheet cassette 3 illustrated in FIG. 2. FIG. 4 is a perspective view of the sheet cassette 3 illustrated in FIG. 2 when viewed from the upper diagonal side. The configuration of sheet cassette 3 will specifically be described below with reference to the drawings.

A cassette case 31 as a "case" of the present invention configuring the body of sheet cassette 3 has an approximately-rectangular shape in a plain view and is formed in a box-like shape with an opening on the upper part thereof. More specifically, the cassette case 31 is configured by a bottom plate 31*a*, a pair of side plates 31*b*, a front mechanism section 31*c* and a rear plate 31*d*. That is, the cassette case 31 is configured to be able to retain papers in piles within a space enclosed by the bottom plate 31*a*, the pair of side plates 31*b*, the front mechanism section 31*c* and the rear plate 31*d*. In the present embodiment, the cassette case 31 is so configured that a number of papers of size A3 (Width 297 mm x Length 420 mm) at maximum can be piled and accommodated therein while the longitudinal direction of the papers being directed in the front-back direction.

A paper pressing plate 32 is provided on the bottom plate 31*a* as the "placement plate" of the preset invention. The paper pressing plate 32 is a plate-like member attached to the cassette case 31, such that on the paper pressing plate 32 a paper is placed, and is formed to favorably retain all usable papers in the width direction. More specifically, the paper pressing plate 32 is formed to have a width in the paper-width direction sufficiently wider than the paper width of the maximum size described above (i.e. A3: 297 mm).

In the present embodiment, the paper pressing plate 32 is so provided that a free end 32*a*, which is an end on the front surface side (i.e. an end at the downstream in the direction of conveyance of the papers retained in piles in the cassette case 31), can move along the piling direction of papers (i.e. in the vertical direction). More specifically, in the paper pressing plate 32, an oscillating center 32*b* which is an end on the back surface side is supported by the pair of side plates 31*b* at both ends thereof in the paper-width direction so as to be oscillatable (rotatable). Note that the paper pressing plate 32 is provided at a position corresponding to the half of the front surface side of the bottom plate 31*a* in the present embodiment. The oscillating center 32*b* is supported at the bottom of the side plate 31*b* and at an approximately-middle part in the front-back direction.

Furthermore, as shown in FIGS. 3 and 4, the paper pressing plate 32 is provided with a pair of openings 32*c* aligned in the paper-width direction. The openings 32C are through holes each having an approximately-rectangular shape in a planar view and are arranged closer to the outer sides in the paper-width direction. Each of the openings 32*c* is formed such that the distance between the edges on the outer sides in the paper-width direction is larger than the paper width of the maximum size described above (A3: 297 mm) while the distance between the edges on the inner sides in the same direction is smaller than the paper width of the minimum size (postcard size: 100 mm). That is, a central portion 32*d*, which is a portion having a width narrower than the paper width of the minimum size described above, is formed between the pair of openings 32*c* of the paper pressing plate 32. The edges on both sides of the central portion 32*d* in the paper-width direction will hereinafter be referred to as "central portion edges 32*d*1."

Here, the maximum size and minimum size correspond to the maximum and minimum sizes of the recording sheet on which an image can be formed by the image forming apparatus, and typically corresponds to the standard paper sizes (standardized by industrial standards or the like for commercially-available papers of sizes A4, B5, postcard, legal, letter and the like). More specifically, A3, A4 or letter size may be set, for example, as the maximum size. As the minimum size, for example, the postcard size may be set.

As shown in FIG. 2, the side plate 31*b* is provided with a pressing-plate driving section 33 which is a mechanism portion for oscillating the paper pressing plate 32. The pressing-plate driving section 33 for configuring a "placement-plate raising mechanism" of the present invention includes a pressing plate contact section 33*a*, a sector gear 33*b*, an intermediate gear 33*c* and a passive gear 33*d*.

The pressing plate contact section 33*a* is, as shown in FIG. 1, a plate-like member with its longitudinal direction corresponding to the paper-width direction, and is provided below the free end 32*a* of the paper pressing plate 32. An end of the pressing plate contact section 33*a* in the paper-width direction is locked by the sector gear 33*b*. The sector gear 33*b* has an oscillating (rotating) center axis provided at the bottom of the side plate 31*b*. The pressing plate contact section 33*a* is provided at an end of the front surface side of the sector gear 33*b* along the radial direction of the sector gear 33*b* when viewed from the side, while the entire portion thereof is in contact with the bottom plate 31*a* (see FIGS. 1 and 2). The pressing plate contact section 33*a* is so configured that the end thereof at the front surface side is raised from the state shown in FIG. 2 as the sector gear 33*b* rotates toward the back surface side.

The sector gear 33*b* is configured to receive a driving force from the passive gear 33*b* which is engaged with a driving gear (not shown) provided on the main body 2 side through the intermediate gear 33*c*. That is, the pressing-plate driving section 33 rotates the pressing plate contact section 33*a* as the passive gear 33*d* receives the driving force from the driving gear described above and thus raises the free end 32*a* of the paper pressing plate 32. Since such a configuration of the pressing-plate driving section 33 has been well-known, further detailed description thereof will not be given in the present specification.

The front mechanism section 31*c* is provided with a separation pad 34 and a roller 35. The separation pad 34 is arranged at more downstream side than the paper pressing plate 32 in the conveying direction (the direction perpendicular to the paper-width direction and the piling direction of papers, i.e. the direction in which a paper is conveyed from the sheet cassette 3 toward the image forming section such as the process cartridge 4). The separation pad 34 is biased upward by a biasing mechanism such as a spring. A separation surface made of material having a friction coefficient higher than that of a paper, such as rubber, is formed on the upper surface of the separation pad 34. The roller 35 is rotatably supported at more downstream side than the separation pad 34 in the conveying direction.

At one side in the paper-width direction, i.e. an end of the front surface side of the cassette case 31 (at the positive direction side on the x axis in the drawings), a side guide 36 serving as the "regulating member" of the present invention is supported to be slidable in the paper-width direction so as to regulate the position of the edge on the above-described one side in the paper-width direction. The side guide 36 includes a base plate 36*a*, a regulating plate 36*b*, an interlocking gear 36*c* and a locking pad 36*d*.

The base plate 36*a* is a planar plate-like member and is provided above the bottom plate 31*a* of the cassette case 31 and below the paper pressing plate 32. The regulating plate 36*b* is a plate-like member so provided as to be orthogonal to the paper-width direction, and the regulating plate 36*b* penetrates through the opening 32*c* from the end on the outer side (one side described above) in the paper-width direction of the base plate 36*a* and protrudes above the paper pressing plate 32 such that a regulating plane RP thereof, which corresponds to the inner surface in the paper-width direction forms a vertical plane perpendicular to the paper-width direction. As the regulating plane RP is in contact with an edge of a paper, the regulating plane 36*b* regulates a position of the edge of the paper in accordance with the size of the paper.

The interlocking gear 36*c* is a plate-like member so provided as to extend from the base plate 36*a* toward the inner side in the paper-width direction and to be interposed between the bottom plate 31*a* of the cassette case 31 and paper pressing plate 32. A gear is formed at the edge on the back surface side of the interlocking gear 36*c* for causing the side guide 36 slide in cooperation with a side guide 37 which will be described later.

Referring to FIG. 4, the locking pad 36*d* formed with elastically-deformable synthetic resin is embedded at the lower end of the regulating plate 36*b*, i.e. a position located to be opposite to a central portion edge 32*d*1 when the paper pressing plate 32 is most lowered. In the present embodiment, the locking pad 36*d* may be a sponge-like member (e.g. urethane foam), which is provided along the entire length of regulating plate 36*b* in the front-back direction.

Figure 5:
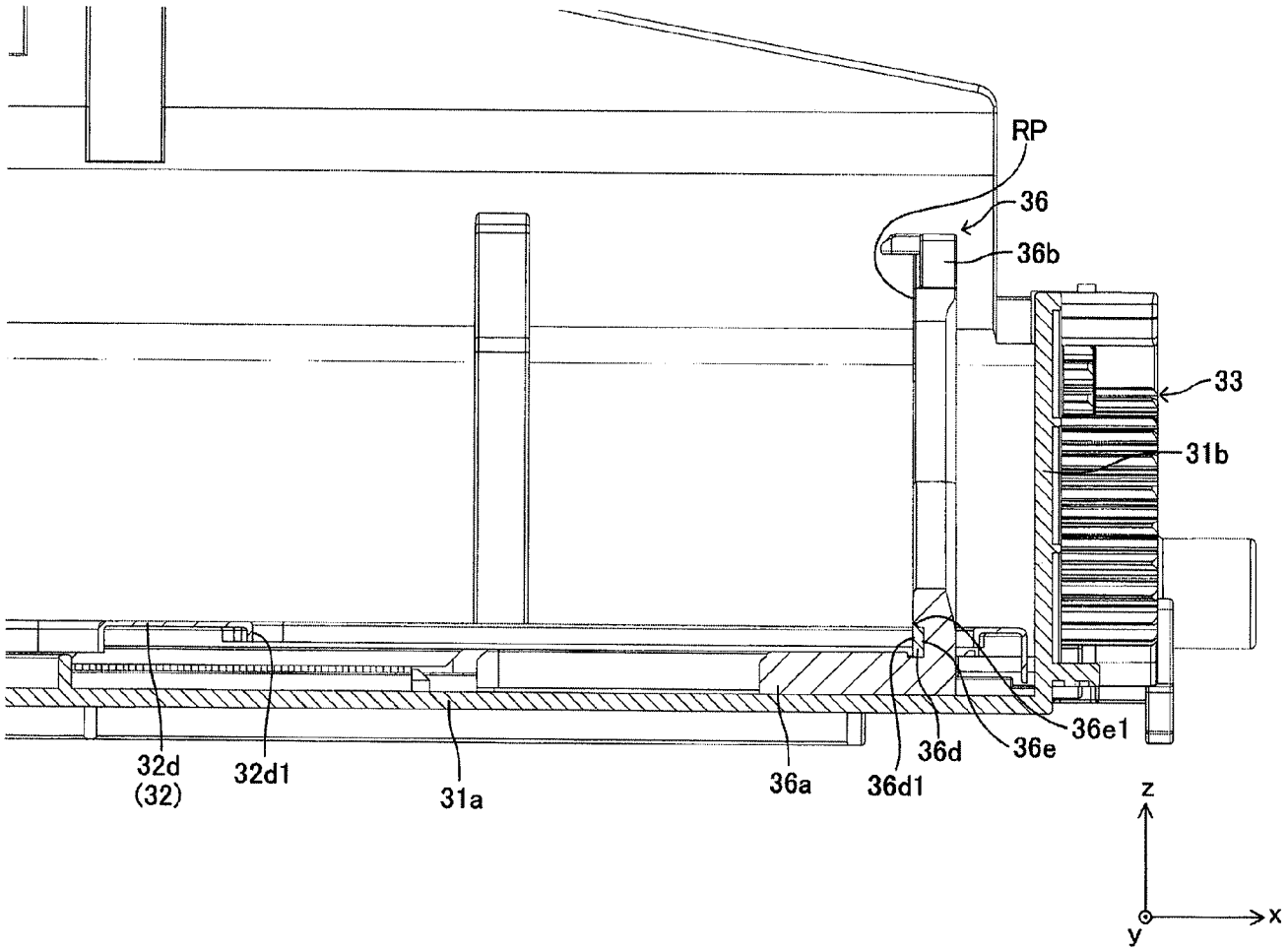
FIG. 5 is an enlarged section view showing the periphery of a side guide illustrated in FIG. 4.

FIG. 5 is an enlarged section view showing the periphery of the side guide 36 illustrated in FIG. 4. Referring to FIG. 5, the locking pad 36*d* configuring the "locking section" and "elastic member" of the present invention is accommodated in a locking-pad accommodating groove 36*e* which is a concave portion formed at the lower end of the regulating plate 36*b*. A chamfer 36*e*1 is provided at the upper end of the locking-pad accommodating groove 36*e*. In addition, a pressing-plate opposite surface 36*d*1, which is a surface of the inner side of the locking pad 36*d* in the paper-width direction, is a surface having a frictional resistance higher than that of the paper pressing plate 32, and is so provided as to be approximately flush with the regulating plate RP in the state where it is not in contact with the central portion edge 32*d*1 of the paper pressing plate 32. That is, the locking pad 36*d* is so configured and arranged as to lock the central portion 32*d* of the paper pressing plate 32 by the frictional force of the pressing-plate opposite surface 36*d*1 in the state where the paper pressing plate 32 is most lowered and the side guide 36 is moved inward to the position at which it becomes in contact with the central portion edge 32*d*1 of the paper pressing plate 32.

Figure 6:
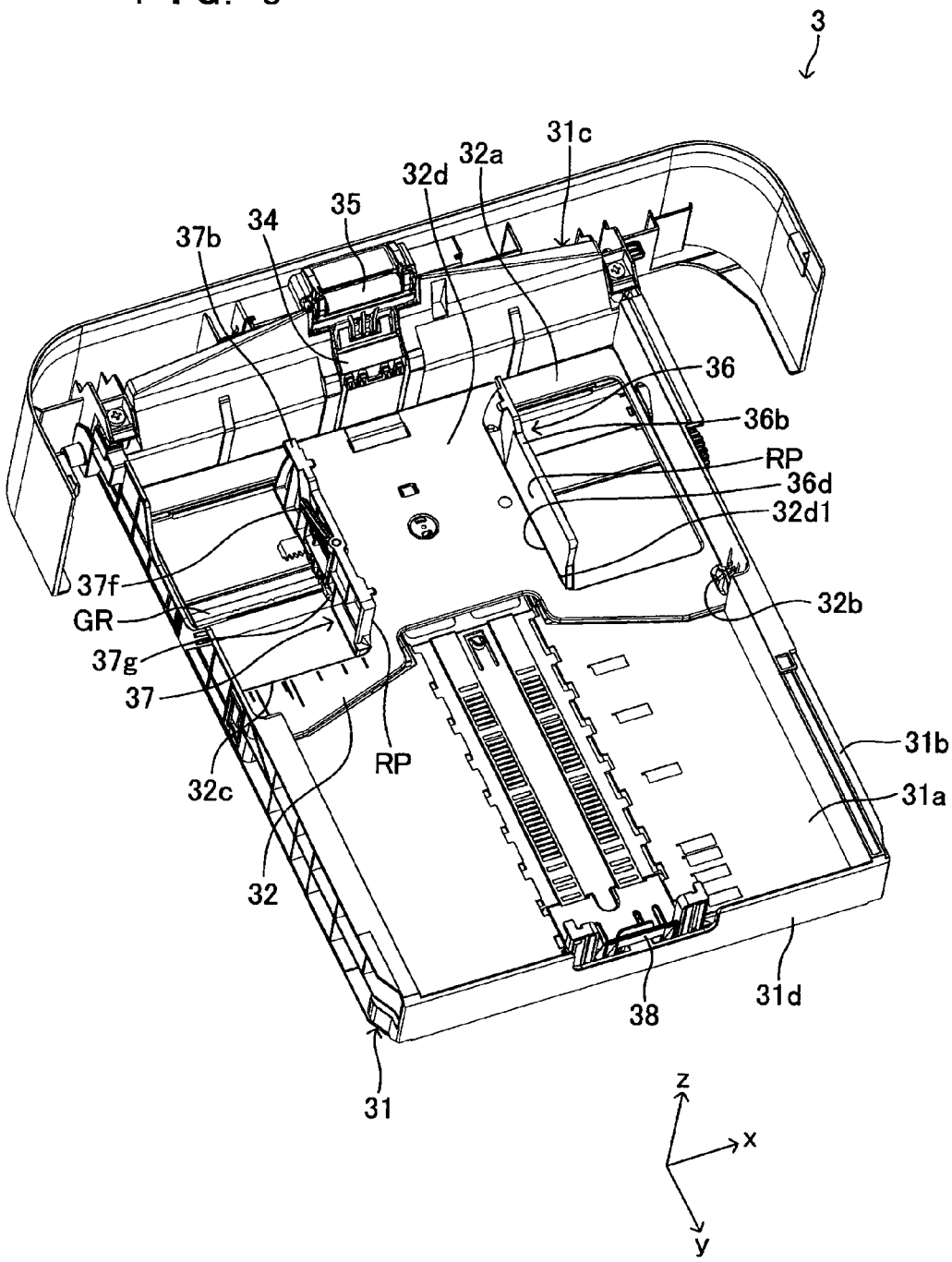
FIG. 6 is a perspective view of the sheet cassette illustrated in FIG. 2 when viewed from the upper diagonal side (showing the state where the side guide is moved from the position shown in FIG. 4 to the inner side in the paper-width direction)

FIG. 6 is a perspective view of the sheet cassette 3 illustrated in FIG. 2 when viewed from the upper diagonal side (showing the state where the side guide 36 is moved from the position shown in FIG. 4 to the inner side in the paper-width direction). At an end on the front surface side of the cassette case 31, i.e. the other side in the paper-width direction (the negative direction side on the x axis in FIG. 6), the side guide 37 serving as the "regulating member" of the present invention is supported to be slidable in the paper-width direction for regulating the position of the edge on the above-described other side in the paper-width direction. The side guide 37 includes a base plate 37*a*, a regulating plate 37*b*, an interlocking gear 37*c*, a locking pad 37*d*, an operation lever 37*f* and a fixing section 37*g*.

The base plate 37*a* is a planar plate-like member and is provided above the bottom plate 31*a* of the cassette case 31 and below the paper pressing plate 32. The regulating plate 37*b* is a planar member so provided as to be orthogonal to the paper-width direction, penetrating through the opening 32*c* from the end on the outer side (the above-described other side) in the paper-width direction of the base plate 37*a* and protruding above the paper pressing plate 32. A locking pad 37*d* configuring the "locking section" and "elastic member" of the present invention is embedded at the bottom of the regulating plate 37*b* as in the regulating plate 36*b* of the side guide 36 described above.

The interlocking gear 37*c* is a plate-like member so provided as to extend from the base plate 36*a* toward the inner side in the paper-width direction and to be interposed between the bottom plate 31*a* of the cassette case 31 and paper pressing plate 32. The interlocking gear 37*c* cooperates with the interlocking gear 36*c* of the side guide 36 to cause the side guide 36 and side guide 37 work together while causing them slide along a guide rail GR provided at the bottom plate 31*a* of cassette case 31 in parallel with the paper-width direction. Such a configuration for causing the pair of side guides 36 and 37 work together to slide is well known (see Japanese Patent Application Laid-Open No. 2006-151609 and Japanese Patent Application Laid-Open No. 2006-151656 if necessary), further detailed description thereof will not be given in the present specification.

The operation lever 37*f* is oscillatably supported by the regulating plate 37*b* at a position more toward the outside than the regulating plane RP of regulating plate 37*b* in the paper-width direction. The operation lever 37*f* is configured to be biased by biasing means (not shown) toward the direction in which a free end thereof is always separated away from the regulating plate 37*b*. The fixing section 37*g* (inhibiting section) is configured to be engaged with the guide rail GR in the state where the operation lever 37*f* is not operated and the free end is separated from the regulating plate 37*b* in order to restrain the side guides 36 and 37 from sliding along the guide rail GR, and is configured to be released from the guide rail GR in the state where the free end of operation lever 37*f* is pressed toward the regulating plate 37*b* in order to allow the side guides 36 and 37 slide along the guide rail GR.

Figure 7A:
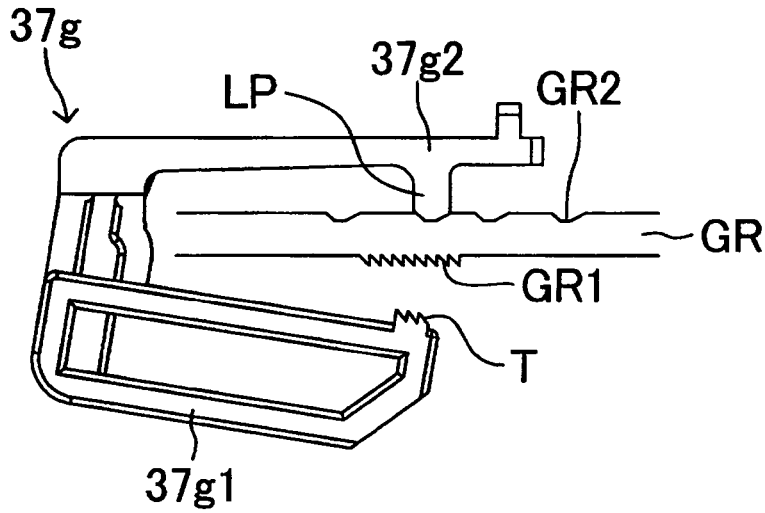
FIGS. 7A and 7B are plan views illustrating enlarged views of a fixing section shown in FIG. 6.
Figure 7B:
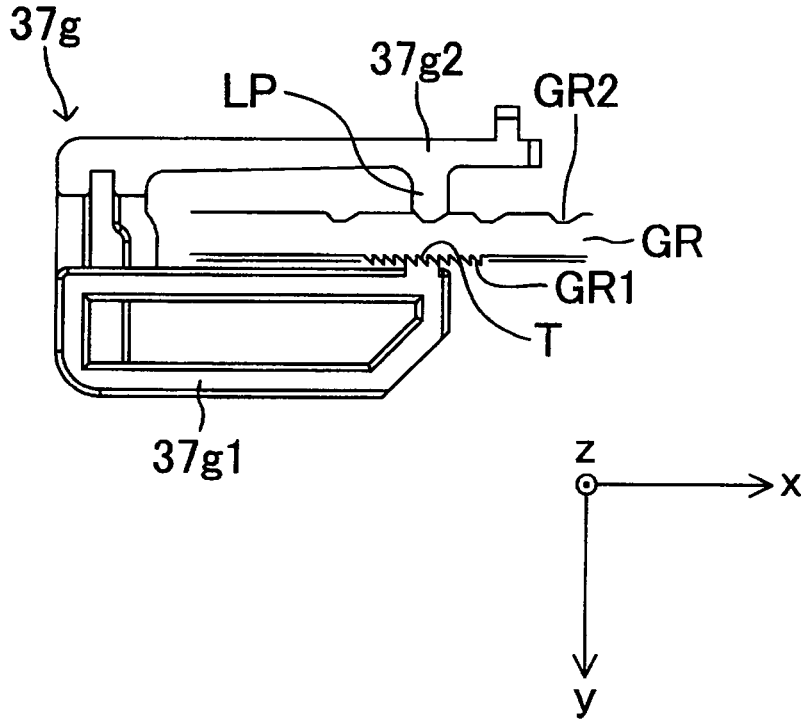

FIGS. 7A and 7B are plan views illustrating enlarged views of the fixing section 37*g* shown in FIG. 6. As illustrated in FIGS. 7A and 7B, the guide rail GR is a rib-like member provided along the paper-width direction to protrude upward from the bottom plate 31*a*. A fixing teeth portion GR1 having a serrated shape is formed on one end face of the guide rail GR in the front-back direction, while a latch portion GR2 which is a recessed portion is formed on the other end face. The fixing teeth portion GR1 and latch portion GR2 are provided on side guides 36 and 37 at positions in accordance with the size of paper. The fixing teeth portion GR1 is formed to lock the side guides 36 and 37 in a fixed manner with respect to the cassette case 31. The latch portion GR2 is formed to generate a feeling of click at a position in accordance with the size of a predetermined standard paper when the side guides 36 and 37 are moved.

The fixing section 37*g* is provided with an oscillating arm 37*g*1 and a fixing arm 37*g*2. The oscillating arm 37*g*1 and fixing arm 37*g*2 are provided to be opposed to each other with the guide rail GR interposed therebetween. The oscillating arm 37*g*1 is so connected to the operation lever 37*f* as to oscillate in accordance with the operation state of operation lever 37*f*. That is, the oscillating arm 37*g*1 is configured to oscillate to be separated away from the guide rail GR in the state where the operation lever 37*f* is pressed, and to be in contact with the guide rail GR in the state where the operation lever 37*f* is released. In addition, the oscillation arm 37*g*1 is provided with a fixing teeth T which engages with the fixing teeth GR1 in the state where it is in contact with the guide rail GR. Note that the fixing teeth GR1 is provided over the entire range of movement for the side guide 37 to engage with the fixing teeth T.

The fixing arm 37*g*2 is configured to be in contact with the guide rail GR irrespective of the operating state of the operation lever 37*f*. The fixing arm 37*g*2 is provided with a latch projection portion LP which is protruding to be engaged with the latch portion GR2. The latch portion GR2 is provided at a position where it is engaged with the latch projection portion LP when the side guide 37 (and side guide 36) is located at a position corresponding to a paper of a predetermined standard size. Note that, since the configurations of the oscillating arm 37*g*1 and fixing arm 37*g*2 are also well known (see Japanese Patent Application Laid-Open No. 2006-151656 if necessary), further detailed description thereof will not be given in the present specification.

Referring to FIG. 3, a rear guide 38 is attached to the bottom plate 31*a* of cassette case 31. The rear guide 38 is provided to be slidable in the front-back direction on the back surface side of the cassette case 31 so as to regulate the position of the back edge of a paper (the edge on the positive direction side on the y axis in FIG. 3). Since the configuration of rear guide 38 is also well known, further detailed description thereof will not be given in the present specification.

Referring again to FIG. 1, the process cartridge 4 is accommodated in the main body 2. The process cartridge 4 is configured such that toner (developer) can be adhered to a paper in manner of a formed image. More specifically, the process cartridge 4 is provided with a photosensitive drum 41, a developing unit 42, a transfer roller 43 and a resist driven roller 44.

The photosensitive drum 41 is an approximately-cylindrical member formed with a photosensitive layer configuring the outer circumference thereof and a metal tube made of aluminum or the like provided inside the photosensitive layer, and is rotatably supported in the process cartridge 4. The developing unit 42 supplies charged toner to a surface of the photosensitive layer on the outer circumference of the photosensitive drum 41 to develop, with the toner, an electrostatic latent image formed on the surface (to adhere the toner to the surface with a pattern in accordance with the electrostatic latent image).

The transfer roller 43 is arranged below and opposite to the photosensitive drum 41 with the paper path PP interposed therebetween. Moreover, the transfer roller 43 is supported in the process cartridge 4 to be driven to rotate about a metal rotating center shaft. The transfer roller 43 is configured by forming a conductive rubber layer around the metal rotating center shaft. The transfer roller 43 is connected to a high-voltage power supply. The transfer roller 43 is configured and arranged such that toner is transferred from the circumferential surface of photosensitive drum 41 to a paper surface by applying voltage between the photosensitive drum 41 and the transfer roller 43.

A resist driven roller 44 is provided at the bottom side of process cartridge 4. The resist driven roller 44 is rotatably supported at the bottom of the casing of process cartridge 4. The resist driven roller 44 is so arranged to be facing the paper path PP.

The scanner unit 5 is arranged in the main body 2 and above the process cartridge 4. The scanner unit 5 is configured to direct laser beam modulated in accordance with image information to the surface of the photosensitive layer on the outer circumference of photosensitive drum 41 so that an electrostatic latent image can be formed on the surface.

The fuser unit 6 is arranged in the main body 2 and more toward the downstream side in the paper conveying direction (the direction in which a paper is conveyed along the paper path PP) than the position where the photosensitive drum 41 and transfer roller 43 are opposed to each other. The fuser unit 6 is configured to pressurize and heat a paper on which toner is adhered through the process cartridge 4 to be able to fuse an image formed by the toner on the paper. The fuser unit 6 is provided with a heat roller 61 and a pressure roller 62.

The heat roller 61 includes a metal cylinder with a demolded surface and a halogen lamp housed in the cylinder, and is configured to be able to rotate in the clockwise direction in FIG. 1. The pressure roller 62 is a roller made of silicon rubber, and is configured to be driven together with the heat roller 61 to rotate in the counter-clockwise direction in FIG. 1, while being pressed with respect to the heat roller 61 with predetermined pressure.

The paper conveying section 7 is so configured as to be able to convey a paper from the sheet cassette 3 to the paper receiving tray 21*a* along the predetermined paper path PP in the main body 2. More specifically, the paper conveying section 7 includes a pickup roller 71, a separation roller 72, a guide roller 73, a resist driving roller 74, a printed-paper guide 75, guide rollers 76 and 77, a paper-discharge driving roller 78 and a paper-discharge driven roller 79.

The pickup roller 71 is arranged at the bottom of main body 2 to be opposed to the free end 32*a* of paper pressing plate 32. The pickup roller 71 is configured to be rotated in the counter-clockwise direction in FIG. 1 in order to convey an edge of a paper in the paper-conveying direction.

The separation roller 72 is arranged to be opposed to the separation pad 34 at the bottom of main body 2. The separation roller 72 is arranged more toward the downstream side than the pickup roller 71 in the paper-conveying direction. The separation roller 72 holds an edge of a paper between the circumferential surface thereof and the separation pad 34 while being rotated in the counter-clockwise direction in FIG. 1, to convey only the paper on the top toward the position between the guide roller 73 and roller 35.

The guide roller 73 is arranged to be opposed to the roller 35. The guide roller 73 is configured to be rotated in the counter-clockwise direction in FIG. 1 such that a paper can be conveyed toward the position between the resist driven roller 44 and resist driving roller 74 while being held between the guide roller 73 and roller 35.

The resist driving roller 74 is arranged to be opposed to the resist driven roller 44. In addition, the resist driving roller 74 is arranged at more upstream in the paper-conveying direction than the position where the photosensitive drum 41 and transfer roller 43 are opposed to each other. The resist driving roller 74 is a roller for adjusting a direction of paper and a timing for conveyance in cooperation with the resist driven roller 44, and is configured to be rotated in the counter-clockwise direction in FIG. 1.

The printed-paper guide 75 is arranged at more toward the back surface side and downstream side in the paper-conveying direction than the fuser unit 6. The guide rollers 76 and 77 are rotatably supported above the printed-paper guide 75. The printed-paper guide 75 is configured to cooperate with the guide roller 76 such that the paper on which an image has been fused by the fuser unit 6 can be conveyed toward the paper discharge outlet 21*b*.

The paper-discharge driving roller 78 and paper-discharge driven roller 79 are positioned near the paper discharge outlet 21*b* inside the main body 2. The paper-discharge driving roller 78 is arranged above the paper-discharge driven roller 79 to be opposed to the paper-discharge driven roller 79 with the paper path PP interposed therebetween. The paper-discharge driving roller 78 is configured to be driven to rotate in the counter-clockwise direction in FIG. 1. The paper-discharge driven roller 79 is rotatably supported by the main body 2. The paper-discharge driven roller 79 is configured to rotate in the clockwise direction in FIG. 1 along with the rotation of the paper-discharge driving roller 78.

<Outline of Image Forming Operation by Laser Printer>

The outline of the image forming operation performed by the laser printer 1 comprising the configuration above will now be described with reference to the drawings.

Referring to FIG. 1, papers piled on the paper pressing plate 32 are biased to the upper side toward the pickup roller 71 by the free end 32*a* of paper pressing plate 32 being raised, abutting the circumferential surface of the pickup roller 71. As the pickup roller 71 is rotated in the counter-clockwise direction in FIG. 1, an edge of at least one paper is moved to the right side in FIG. 1 and is sandwiched between the separation roller 72 and separation pad 34. The separation roller 72 is then rotated in the counter-clockwise direction in FIG. 1 while the edge of at least one paper is sandwiched between the separation roller 72 and separation pad 34, to convey only the edge of the paper on the top in the paper-conveying direction along with the rotation of the separation roller 72.

The edge of one paper conveyed by the separation roller 72 in the paper-conveying direction is conveyed toward the position between the guide roller 73 and roller 35. The edge of the paper is then conveyed toward the position between the resist driving roller 74 and resist driven roller 44 by the rotation of guide roller 73 in the counter-clockwise direction in FIG. 1.

After the edge of the paper abuts a contact section (resist portion) between the resist driven roller 44 and resist driving roller 74, the resist driving roller 74 is driven to rotate at a predetermined timing. As the resist driven roller 44 rotates along with the rotation of the resist driving roller 74, the paper is conveyed toward a transfer position at which the photosensitive drum 41 and the transfer roller 43 are opposed to each other. This allows an obliquely-passing paper to be corrected and a conveyance timing to be adjusted.

While the paper is conveyed toward the transfer position as described above, the scanner unit 5 forms an electrostatic latent image on the circumferential surface of photosensitive drum 41, and the electrostatic latent image is developed by the developing unit 42. That is, an image formed with toner is carried on the circumferential surface of photosensitive drum 41. The toner on the circumferential surface of the photosensitive drum 41 is transferred to the paper surface at the above-described transfer position by applying voltage between the photosensitive drum 41 and transfer roller 43. This allows the toner image to be formed on the paper surface.

The paper on which the toner image is transferred as described above is sent to the fuser unit 6 and sandwiched between the heat roller 61 and pressure roller 62 to be pressed and heated. Accordingly, the toner image is fused on the paper surface. Thereafter, the paper on which the toner image is fused is conveyed to the position between the paper-discharge driving roller 78 and paper-discharge driven roller 79 while being guided by the printed-paper guide 75 as well as the guide rollers 76 and 77. The paper-discharge driving roller 78 is driven to rotate to discharge the printed paper from the paper discharge outlet 21*b*, the paper then being placed on the paper receiving tray 21*a*.

Effects by Configuration of Embodiment

Effects of the present embodiment will be described below. The operation lever 37*f* is pressed while the sheet cassette 3 is taken out of the main body 2, allowing the positions of the side guides 36 and 37 in the paper-width direction to be adjusted. In such a state, as shown in FIG. 4, the paper pressing plate 32 is most lowered until the free end 32*a* abuts the bottom plate of cassette case 31.

Here, the operation lever 37*f* is pressed while the side guide 37 is moved to the inner side in the paper-width direction such that the locking pad 37*d* becomes in contact with the central portion edge 32*d*1 of the paper pressing plate 32, so that the locking pad 36*d* of side guide 36 is also in contact with the central portion edge 32*d*1 of paper pressing plate 32. Accordingly, the central portion 32*d* of paper pressing plate 32 is locked from both sides in the paper-width direction by the locking pad 36*d* of side guide 36 and the locking pad 37*d* of side guide 37. Thereafter, the pressing operation by the operation lever 37*f* is released to maintain the state where the central portion 32*d* of the paper pressing plate 32 is being locked (this state will hereinafter be referred to as "pressing plate fixing mode").

The pressing plate fixing mode is realized when the side guides 36 and 37 are located in an area different from an area between the maximum size and minimum size at the edge in the paper-width direction of the paper of a standard size held in the cassette case 31 (specifically, at an inner side than the area between the maximum size and minimum size). Moreover, the inner surfaces of locking pads 36*d* and 37*d* in the paper-width direction (see pressing-plate opposite surface 36*d*1 in FIG. 5) are so provided as to be approximately flush with the regulating plane RP. Thus, the configuration in which the side guides 36 and 37 lock the paper pressing plate 32 at the time of transportation or the like will not cause a problem for conveyance of the papers held in the cassette case 31 to the main body 2.

The configuration in which the side guides 36 and 37 lock the paper pressing plate 32 at the time of transportation or the like is provided in the side guides 36 and 37 as well as the paper pressing plate 32 supported by the cassette case 31 so that it cannot be easily separated therefrom. Thus, no special component (which may be unnecessary waste or may be lost) is used for fixing the paper pressing plate 32. According to the present embodiment, therefore, a configuration in which the paper pressing plate 32 can be fixed at the time of transportation or the like in a favorable and reusable manner without increase in cost or generation of excessive waste.

In particular, the locking pads 36*d* and 37*d* which are elastically deformable members are used to favorably alleviate the impact on the paper pressing plate 32. Accordingly, even in the case where a large impact is caused to the device in, for example, a drop test for the top surface in a packaged state, deformation of the paper pressing plate 32 can preferably be prevented.

Furthermore, in the pressing plate fixing mode described above, the central portion edge 32*d*1 of paper pressing plate 32 is locked by the frictional force caused by the locking pads 36*d* and 37*d*. Here, due to elastic deformation of the locking pads 36*d* and 37*d*, the central portion edge 32*d*1 moves by a small amount into the concave portion (see locking-pad accommodating groove 36*e* in FIG. 5) accommodating the locking pads 36*d* and 37*d*. When the sheet cassette 3 is attached to the main body 2 and the power of laser printer 1 is turned on in such a state, the central portion edge 32*d*1 of paper pressing plate 32 can pass over the chamfer 36*e*1 to be raised, smoothly leaving the concave portion described above, even if the pressing-plate driving section 33 is operated. Thus, in the present embodiment, even if the pressing-plate driving section 33 is driven while the pressing plate fixing mode is not released by the user, the paper pressing plate 32 can easily be released. This preferably prevents occurrence of damage in the components.

Examples in Modification

Note that the embodiment described above is a mere illustration of a representative example of the present invention the applicant considered as best at the time of application of the present invention. The present invention is, therefore, not at all limited to the above-described embodiment. It should be understood that various modifications can be applied to the embodiment described above within the scope not changing the essential parts of the invention.

Several representative modifications will be described below. In the description of modifications below, a reference code similar to that in the above-described embodiment may be used for a component with configuration and function similar to those of the component described in the embodiment above. For such a component, the description in the embodiment above will be employed as long as it is technically consistent. It should further be understood that the present invention will not be limited to the modifications described below. Moreover, more than one modified examples may be employed as appropriate within the scope of technical consistency.

The material and shape of locking pad 36*d* is not limited to any of the examples described above. For example, synthetic rubber or the like may also be used as material for the locking pad 36*d*. Moreover, if the paper pressing plate 32 (or at least parts thereof which are opposed to the locking pads 36*d* and 37*d*) is formed of iron-based material which attracts a magnet, each of the locking pads 36*d* and 37*d* may also be formed of a permanent magnet. In such a case, a so-called "rubber magnet" is preferably used, specifically, for each of the locking pads 36*d* and 37*d*.

Referring to FIG. 5, the pressing-plate opposite surface 36*d*1 of the locking pad 36*d* may be located at a position more toward the outside than the regulating plane RP in the paper-width direction (i.e. at an inner side of locking-pad accommodating groove 36*e*: more specifically, at a position corresponding to the outer edge in the paper-width direction and the lower end of chamfer 36*e*1).

Figure 8:
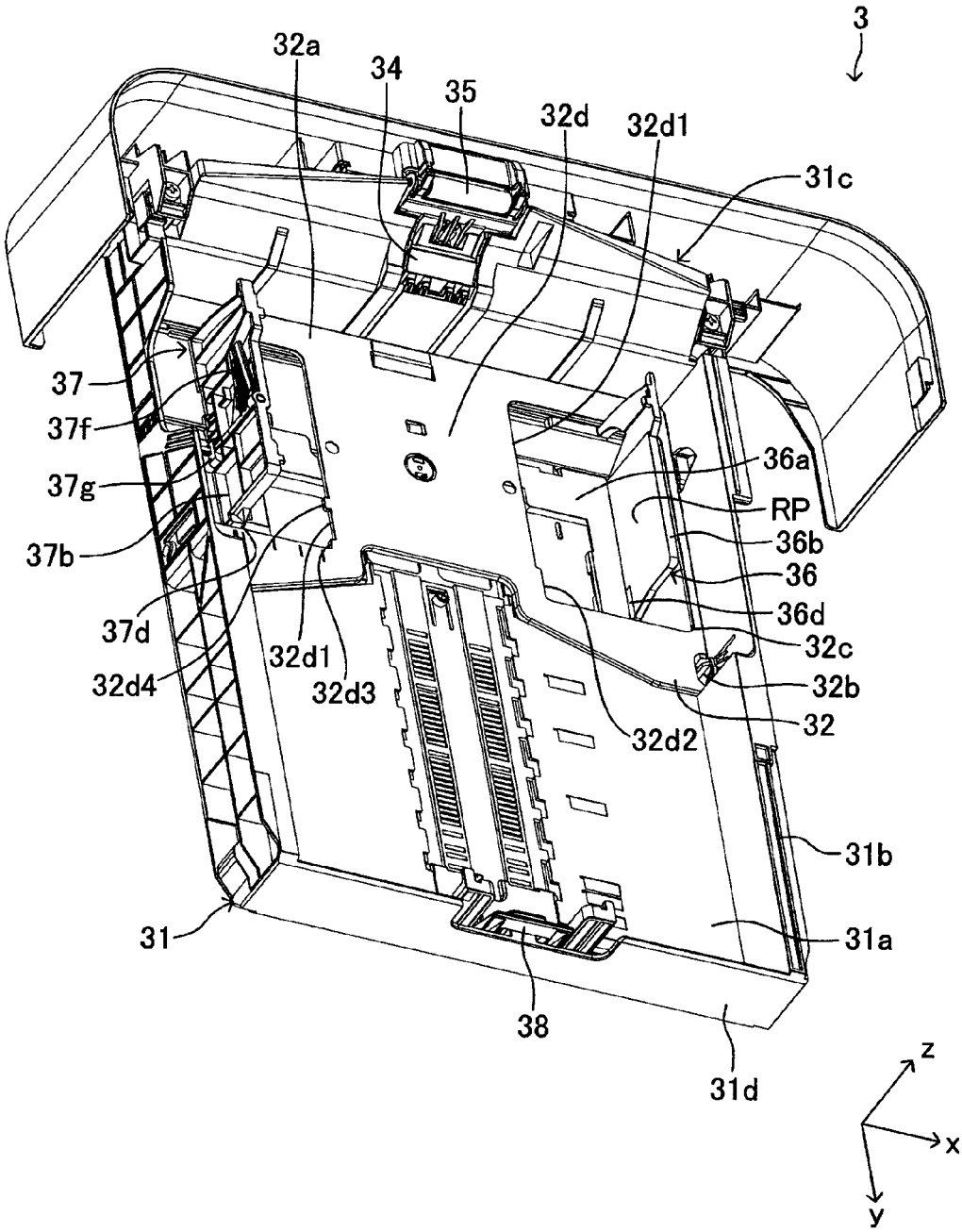
FIG. 8 is a perspective view illustrating a configuration of a modification of the sheet cassette shown in FIG. 4.

FIG. 8 is a perspective view illustrating the configuration of a modification of the sheet cassette 3 shown in FIG. 4. As shown in FIG. 8, the locking pad 36*d* may be provided only at a part of the side guide 36 in the front-back direction. Similarly, the locking pad 37*d* may be provided only at a part of the side guide 37 in the front-back direction.

In such a case, protrusion portions 32*d*2 and 32*d*3 are provided at the central portion 32*d* of paper pressing plate 32 to protrude from the central portion edge 32*d*1 toward the locking pads 36*d* and 37*d*. The protrusion portions 32*d*2 and 32*d*3 are configured to be accommodated in the concave portion (see locking-pad accommodating groove 36*e* in FIG. 5), which receives the locking pads 36*d* and 37*d*, by elastically deforming the locking pads 36*d* and 37*d* when the regulating plane RP of each of the side guides 36 and 37 abuts the central portion edge 32*d*1 (a portion where the protrusion portion 32*d*2 and 32*d*3 are not provided) of the paper pressing plate 32.

In addition, as shown in FIG. 8, the protrusion portion 32*d*2 protruding toward the locking pad 36*d* and the protrusion portion 32*d*3 protruding toward the locking pad 37*d* may have different positions and shapes. Moreover, as shown in FIG. 8, a plurality of protrusion portions 32*d*3 and 32*d*4 may additionally be provided at the central portion edge 32*d*1 on one side in the paper-width direction.

Figure 9:
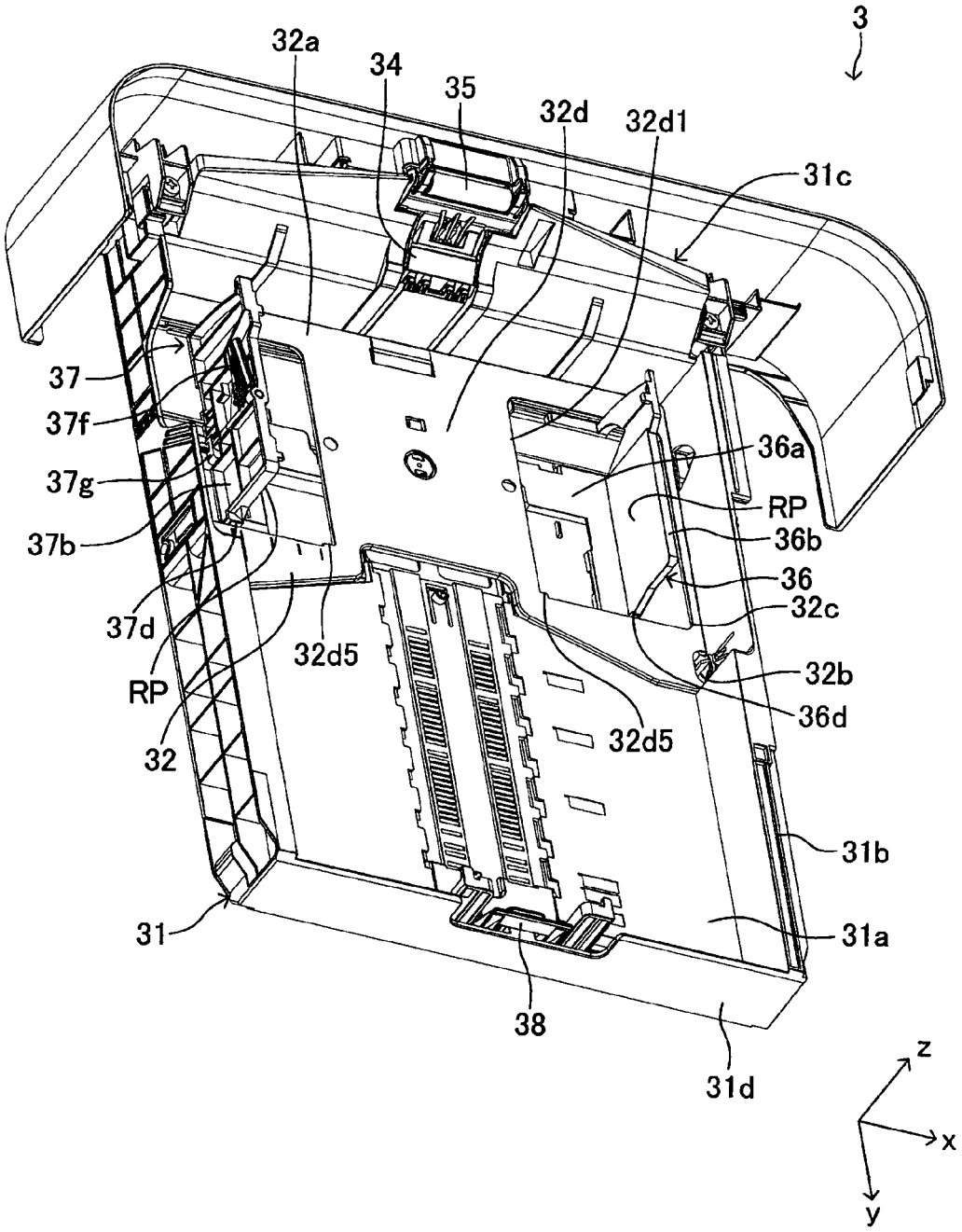
FIG. 9 is a perspective view illustrating a configuration of another modification of the sheet cassette shown in FIG. 4.

FIG. 9 is a perspective view illustrating a configuration of another modification of the sheet cassette 3 shown in FIG. 4. As shown in FIG. 9, protrusion portions 32*d*5 protruding toward the locking pads 36*d* and 37*d* may be provided so as to protrude along the front-back direction. Here, the locking pads 36*d* and 37*d* are provided at the end faces (end faces on the back surface side in the example shown in FIG. 9) of side guides 36 and 37, respectively, each of the end faces intersecting with the corresponding regulating plane RP.

The configuration in which the paper pressing plate 32 is locked at the side guides 36 and 37 may be provided at least one of the side guides 36, 37 and the paper pressing plate 32. Furthermore, the side guides 36 and 37 may be configured to lock the paper pressing plate 32 when they are moved to the outermost sides in the paper-width direction compared to the area between the maximum size and minimum size at the edge of a paper in the paper-width direction.

It should be understood that other modifications not specified here are also included in the technical scope of the present invention within the range not changing the essential part of the present invention. Moreover, various elements configuring means for solving the problems of the present invention and expressed in the operational and functional manner include any structure which can realize such operation and function in addition to the specific structures disclosed in the embodiment and modifications described above. Furthermore, the disclosure in other applications and publications cited in the present specification is considered to configure a part of the present specification and may be employed as necessary and within the scope of technical consistency.

As this description may be embodied in several forms without departing from the spirit of essential characteristics thereof, the present embodiment is therefore illustrative and not restrictive, since the scope is defined by the appended claims rather than by the description preceding them, and all changes that fall within metes and bounds of the claims, or equivalence of such metes and bounds thereof are therefore intended to be embraced by the claims.

What is claimed is:

1. A recording-sheet retaining device, comprising:

a case configured to retain recording sheets in piles;

a regulating member in contact with an edge, in a width direction, of the recording sheet for regulating a position of the edge, and supported by the case to be slidable in the width direction;

a placement plate configured to receive placement of the recording sheet, and provided in the case to be movable upward and downward; and a locking section provided on at least one of the placement plate and the regulating member so as to lock the placement plate with respect to the regulating member when the regulating member is located in an area different from an area between a maximum size and a minimum size at the edge of the recording sheet in the width direction, wherein the locking section includes an elastic member formed of synthetic resin and provided in a longitudinal direction of the recording sheet.

2. The recording-sheet retaining device according to claim 1, further comprising an inhibiting section configured to inhibit the regulating member from sliding with respect to the case.

3. The recording-sheet retaining device according to claim 1, wherein the locking section is provided on the regulating member at a position opposite to the placement plate in a state where the placement plate is at a lowest position.

4. The recording-sheet retaining device according to claim 1, wherein the elastic member has a surface opposite to the placement plate, and the surface is provided so as to be approximately flush with a surface of the regulating member that is in contact with the edge in a state where the surface of the elastic member is not in contact with the placement plate.

5. The recording-sheet retaining device according to claim 1, wherein the elastic member is opposed to the placement plate and has a placement-plate opposite surface with a frictional resistance higher than a frictional resistance of the placement plate.

6. The recording-sheet retaining device according to claim 1, wherein the locking section includes a protrusion portion protruding from an end face of the placement plate, opposite to the regulating member, toward the regulating member, and a concave portion provided at the regulating member and configured to accommodate the protrusion portion.

7. The recording-sheet retaining device according to claim 6, wherein an upper end of the concave portion is provided with a chamfer.

8. The recording-sheet retaining device according to claim 1, wherein the locking section is provided on a face of the regulating member in the width direction.

9. The recording-sheet retaining device according to claim 1, further comprising:

a placement-plate raising mechanism configured to raise the placement plate in response to reception of a driving force, wherein the locking section is configured to release the placement place from the regulating member when the placement-plate raising mechanism receives the driving force.

10. A recording-sheet retaining device, comprising:

a case configured to retain recording sheets in piles;

a regulating member in contact with an edge, in a width direction, of the recording sheet for regulating a position of the edge, and supported by the case to be slidable in the width direction;

a placement plate configured to receive placement of the recording sheet, and provided in the case to be movable upward and downward; and a locking section provided on at least one of the placement plate and the regulating member so as to lock the placement plate with respect to the regulating member when the regulating member is located in an area different from an area between a maximum size and a minimum size at the edge of the recording sheet in the width direction, wherein the locking section includes a protrusion portion protruding from an end face of the placement plate, opposite to the regulating member, toward the regulating member, and a concave portion provided at the regulating member and configured to accommodate the protrusion portion.

11. The recording-sheet retaining device according to claim 10, wherein an upper end of the concave portion is provided with a chamfer.

* * * * *